US007800597B2

(12) United States Patent
Hong

(10) Patent No.: US 7,800,597 B2
(45) Date of Patent: Sep. 21, 2010

(54) DISPLAY DEVICE, APPARATUS FOR DRIVING THE SAME AND METHOD OF DRIVING THE SAME

(75) Inventor: Sunkwang Hong, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 982 days.

(21) Appl. No.: 11/153,064

(22) Filed: Jun. 15, 2005

(65) Prior Publication Data

US 2006/0038837 A1 Feb. 23, 2006

(30) Foreign Application Priority Data

Aug. 20, 2004 (KR) ..... 2004-65893

(51) Int. Cl.
*G09G 5/00* (2006.01)

(52) U.S. Cl. ..... 345/204; 345/89; 345/99; 345/690

(58) Field of Classification Search ..... 345/204, 345/89, 99, 690
See application file for complete search history.

(56) References Cited

U.S. PATENT DOCUMENTS

| | | | | |
|---|---|---|---|---|
| 7,161,576 | B2 * | 1/2007 | Kawabe et al. | 345/99 |
| 2003/0006952 | A1 * | 1/2003 | Hong | 345/89 |
| 2003/0012899 | A1 | 1/2003 | Kemmochi et al. | |
| 2006/0158410 | A1 * | 7/2006 | Fujine | 345/89 |

* cited by examiner

*Primary Examiner*—Richard Hjerpe
*Assistant Examiner*—Leonid Shapiro
(74) *Attorney, Agent, or Firm*—Innovation Counsel LLP

(57) ABSTRACT

A display device has a display panel and a driver. The display panel displays an image signal. The driver provides the display panel with a frame data in a first sub frame using a first gamma curve that has a first gamma value, and provides the display panel with the frame data in a second sub frame using a second gamma curve that has a second gamma value, wherein the second gamma value is greater than the first gamma value. Therefore, the display device may have an improved brightness and display moving pictures in a high display quality.

34 Claims, 7 Drawing Sheets

DISPLAY DEVICE, APPARATUS FOR DRIVING THE SAME AND METHOD OF DRIVING THE SAME

CLAIM FOR PRIORITY

This application claims priority under 35 USC §119 to Korean Patent Application No. 2004-65893, filed on Aug. 20, 2004, the content of which is herein incorporated by reference in its entirety for all purposes.

BACKGROUND OF THE INVENTION

1. Field of the Invention

The present invention relates to a display device and an apparatus for driving the same and a method of driving the display device that displays moving pictures in a higher quality.

2. Description of the Related Art

Generally, a liquid crystal display (LCD) device employs a hold-type display, whereas a cathode ray tube (CRT) employs an impulse-type display. The LCD device exhibits a poor quality in displaying moving pictures because the response speed of the liquid crystal is slower than a one-frame period (i.e., a time period corresponding to one frame), causing a blurry display of the image. To suppress the motion blur, a black picture is periodically used to intercept a light emitted from pixels.

However, the black-picture insertion method still has a technological problem in that data loss can happen at a white or black gray scale level where the generation of the motion blur is relatively trivial.

In addition, the method of inserting the black picture to every frame results in lower brightness. Furthermore, when a frame frequency is 60 Hz (i.e., frame cycle is 16.7 msec), sixty frames must be displayed in a second; however, only thirty frames are displayed due to the insertion of the black picture. Therefore, an amount of data shown during a frame cycle is reduced.

Accordingly, the quality of the moving pictures is degraded when displayed in the liquid crystal display device.

SUMMARY OF THE INVENTION

Accordingly, the present invention is provided to substantially obviate one or more problems due to limitations and disadvantages of the related art.

Exemplary embodiments of the present invention provide a display device to displays moving pictures with an improved display quality.

In some embodiments of the present invention, the display device includes a display panel configured to display an image signal and a driver configured to provide the display panel with a frame data in a first sub frame using a first gamma curve and configured to provide the display panel with the frame data in a second sub frame using a second gamma curve whose gamma value is greater than a gamma value of the first gamma curve. The second sub frame includes m (m is an integer) sub frames using m second gamma curves that have gamma values greater than the gamma value of the first gamma curve.

Exemplary embodiments of the present invention also provide an apparatus for driving a display device having a display panel for displaying an image signal. In some embodiments of the present invention, the apparatus includes a gamma storing unit configured to store a first reference gray scale data corresponding to a first gamma curve and a second reference gray scale data corresponding to a second gamma curve whose gamma value is greater than a gamma value of the first gamma curve, a reference gray scale voltage generation unit configured to generate a first reference gray scale voltage and a second reference gray scale voltage based on the first and second reference gray scale data, respectively and a data driver configured to convert the frame data into first and second data voltages based on the first and second reference gray scale voltages, respectively, and configured to provide the converted first and second data voltages to the display panel.

Exemplary embodiments of the present invention still also provide a method of driving a display device. In the method, a frame data is received from an external device. A first sub frame is displayed using a first gamma curve during a first interval of a frame cycle of the frame data and a second sub frame is displayed using a second gamma curve whose gamma value is greater than a gamma value of the first gamma curve during a second interval of the frame cycle.

According to the present invention, the motion blur may be eliminated and the brightness of an image may be improved.

BRIEF DESCRIPTION OF THE DRAWINGS

The present invention will become more apparent to those of ordinary skill in the art by describing, in detail, exemplary embodiments thereof with reference to the attached drawings, wherein like elements are represented by like reference numerals, which are given by way of illustration only and thus do not limit the exemplary embodiments of the present invention, in which.

DESCRIPTION OF THE EXEMPLARY EMBODIMENTS

Hereinafter, the present invention will be explained in detail with reference to the accompanying drawings.

Figure 1:
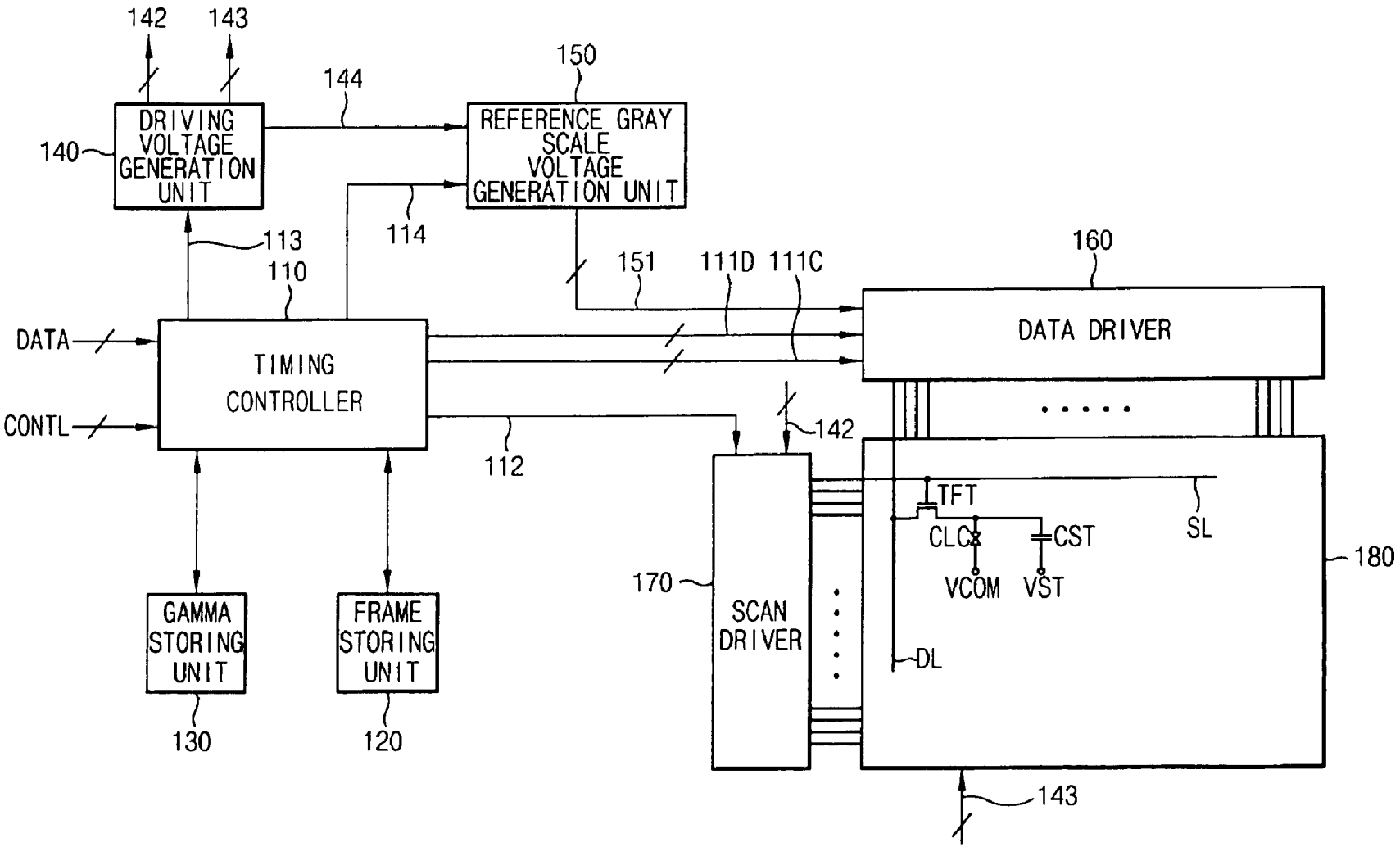
FIG. 1 is a block diagram illustrating a liquid crystal display device according to an exemplary embodiment of the present invention.

FIG. 1 is a block diagram illustrating a liquid crystal display device according to an exemplary embodiment of the present invention.

Referring to FIG. 1, the liquid crystal display device includes a timing controller 110, a frame storing unit 120, a gamma storing unit 130, a driving voltage generation unit 140, a reference gray scale voltage generation unit 150, a data driver 160, a scan driver 170 and a liquid crystal display panel 180.

The timing controller 110 controls an overall operation of the liquid crystal display device based on a control signal CONTL provided from an external device. Particularly, the control signal CONTL includes a main clock signal MCLK, a horizontal synchronization signal HSYNC, a vertical synchronization signal VSYNC and a data enable signal DE. The control signal CONTL further includes a gamma selection signal transmitted from a user interface (not shown) by a user. The gamma selection signal is a control signal for selecting a particular gamma curve among various gamma curves that are stored in the gamma storing unit 130.

The timing controller 110 provides control signals 111C including a horizontal synchronization start signal STH for controlling the data driver 160, an inversion signal RVS and a load signal TP, and control signals 112 including a scan start signal STV for controlling the scan driver 170, a scan clock signal CPV and an output enable signal OE, based on the control signal CONTL. Further, the timing controller 110 provides control signals 113 including the main clock signal MCLK for controlling the driving voltage generation unit 140 and the inversion signal RVS.

Additionally, the timing controller 110 selects a reference gray scale data for the respective gamma curves stored in the gamma storing unit 130 to provide the reference gray scale data 114 to the reference gray scale voltage generation unit 150. For example, a given reference gray scale data corresponding to a predefined gamma curve may be outputted, or the reference gray scale data corresponding to the gamma curve selected by a user may be outputted.

The frame storing unit 120 stores an image data DATA inputted from the external device by a unit of a frame. The timing controller 110 stores the image data DATA inputted at a first driving frequency in the frame storing unit 120 and outputs the stored image data DATA to the data driver 160 in synchronization with a second driving frequency. Here, the second driving frequency may be m (m is an integer) times the first driving frequency.

For example, when the first driving frequency is 60 Hz and the second driving frequency is 120 Hz, an n-th frame data may be driven by the second driving frequency so that the n-th frame data are displayed in two sub frames on the liquid crystal display panel 180 during a frame cycle according to the first driving frequency (Namely, 1/60 second). Thus, the n-th frame data may be displayed in m sub frames on the liquid crystal display panel 180 by driving the frame with the second driving frequency that is m multiplied by the first driving frequency.

The gamma storing unit 130 may correspond to a read only memory (ROM) to store sampled reference gray scale data according to a plurality of gamma (γ) correction curves. For example, eight sampled reference gray scale data for a first gamma (γ=2.2) correction curve may be stored in the gamma storing unit 130 and eight sampled reference gray scale data for a second gamma (γ=5.2) correction curve may be stored in the gamma storing unit 130. In the same manner, sampling reference gray scale data according to various gamma curves are stored, respectively, in the gamma storing unit 130.

Based on the stored reference gray scale data, the timing controller 110 may display the n-th frame data in a first sub frame using a normal gamma curve and display the n-th frame data in at least one second sub frame using at least one gamma curve that has a greater gamma value than the normal gamma curve.

The driving voltage generation unit 140 generates driving voltages for driving the liquid crystal display device. Particularly, the driving voltage generation unit 140 provides the scan driver 170 with scan voltages 144 (VON and VOFF) and provides the liquid crystal display panel 180 with common electrode voltages 143 (VCOM and VST). In addition, the driving voltage generation unit 140 provides the reference gray scale voltage generation unit 150 with a reference voltage 144 (VREF).

The reference gray scale voltage generation unit 150 converts the reference voltage 144 (VREF) provided from the driving voltage generation unit 140 into a reference gray scale voltage 151 based on the reference gray scale data from the gamma storing unit 130. The converted reference gray scale voltage 151 is provided to the data driver 160. For instance, the reference voltage 144 (VREF) may be converted into eight reference gray scale voltages VR1 through VR8 using eight reference gray scale data corresponding to a first gamma curve.

The data driver 160 receives the image data 111D (DATA) and converts the input image data 111D into an analog data voltage based on the reference gray scale voltage provided from the reference gray scale voltage generation unit 150. The analog data voltage is outputted to the liquid crystal display panel 180.

The scan driver 170 generates scan signals and provides the scan signals to the liquid crystal display panel 180.

The liquid crystal display panel 180 includes a lower substrate (or array substrate), an upper substrate and a liquid crystal layer placed between the array substrate and the upper substrate. The array substrate includes a plurality of data lines DL, a plurality of scan lines SL, and a plurality of unit pixels that are formed on regions defined by the data lines DL and the scan lines SL. The data lines DL are extended in a first direction, and the gate lines GL are insulated from the data lines DL to be extended in a second direction substantially perpendicular to the first direction.

Each of the unit pixels includes a switching element (TFT), a liquid crystal capacitor CLC and a storage capacitor CST. The switching element (TFT) has a gate electrode and a source electrode electronically coupled to the scan line SL and the data line DL, respectively, and a drain electrode electronically coupled to a first end of the liquid crystal capacitor CLC and a first end of the storage capacitor CST. A second end of the liquid crystal capacitor CLC is coupled to the common electrode voltage VCOM and a second end of the storage capacitor CST is coupled to the common electrode voltage VST.

The upper substrate may have a color filter to represent colors corresponding to the pixels formed on the array substrate. A common electrode to which the second end of the liquid crystal capacitor CLC is coupled is formed on the upper substrate.

Figure 2:
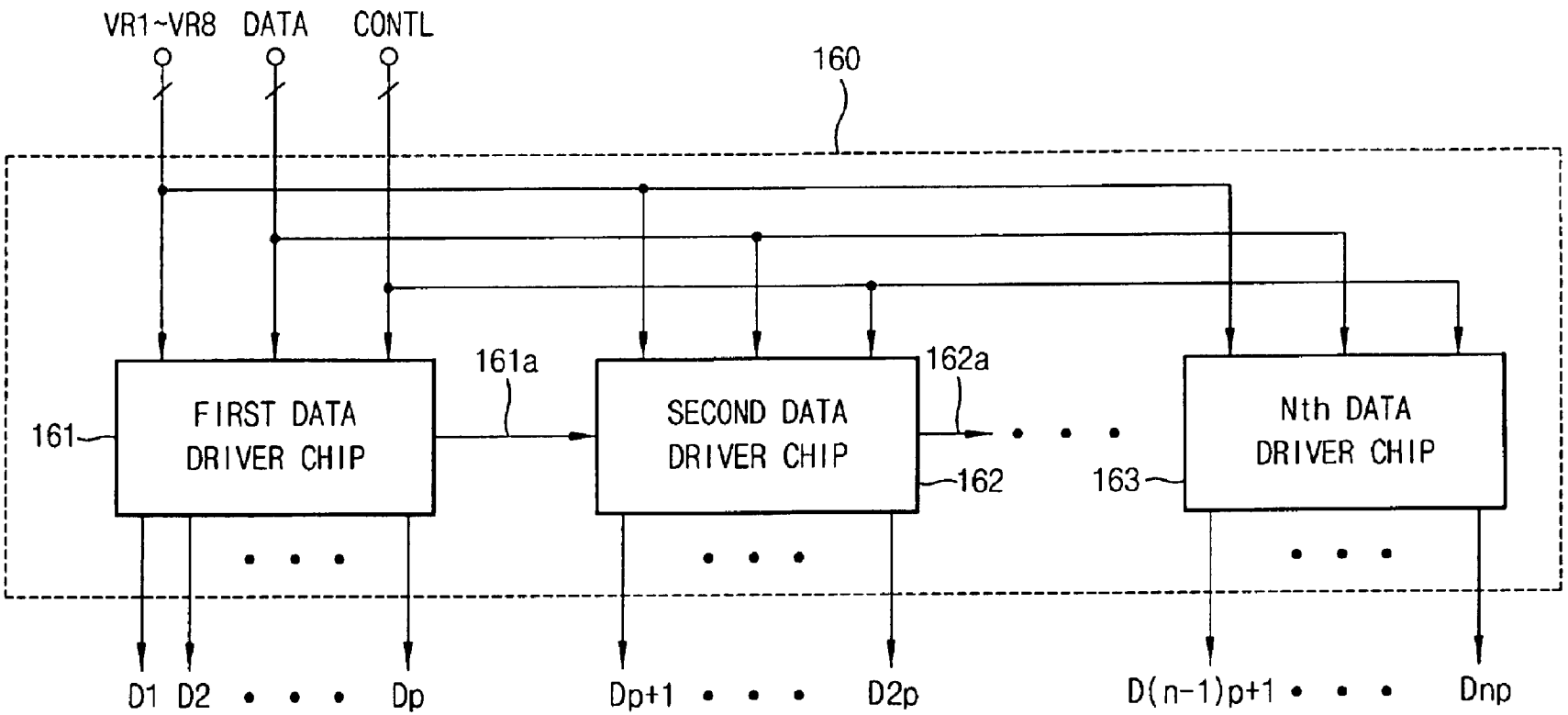
FIG. 2 is a block diagram illustrating a data driver in FIG. 1.
Figure 3:
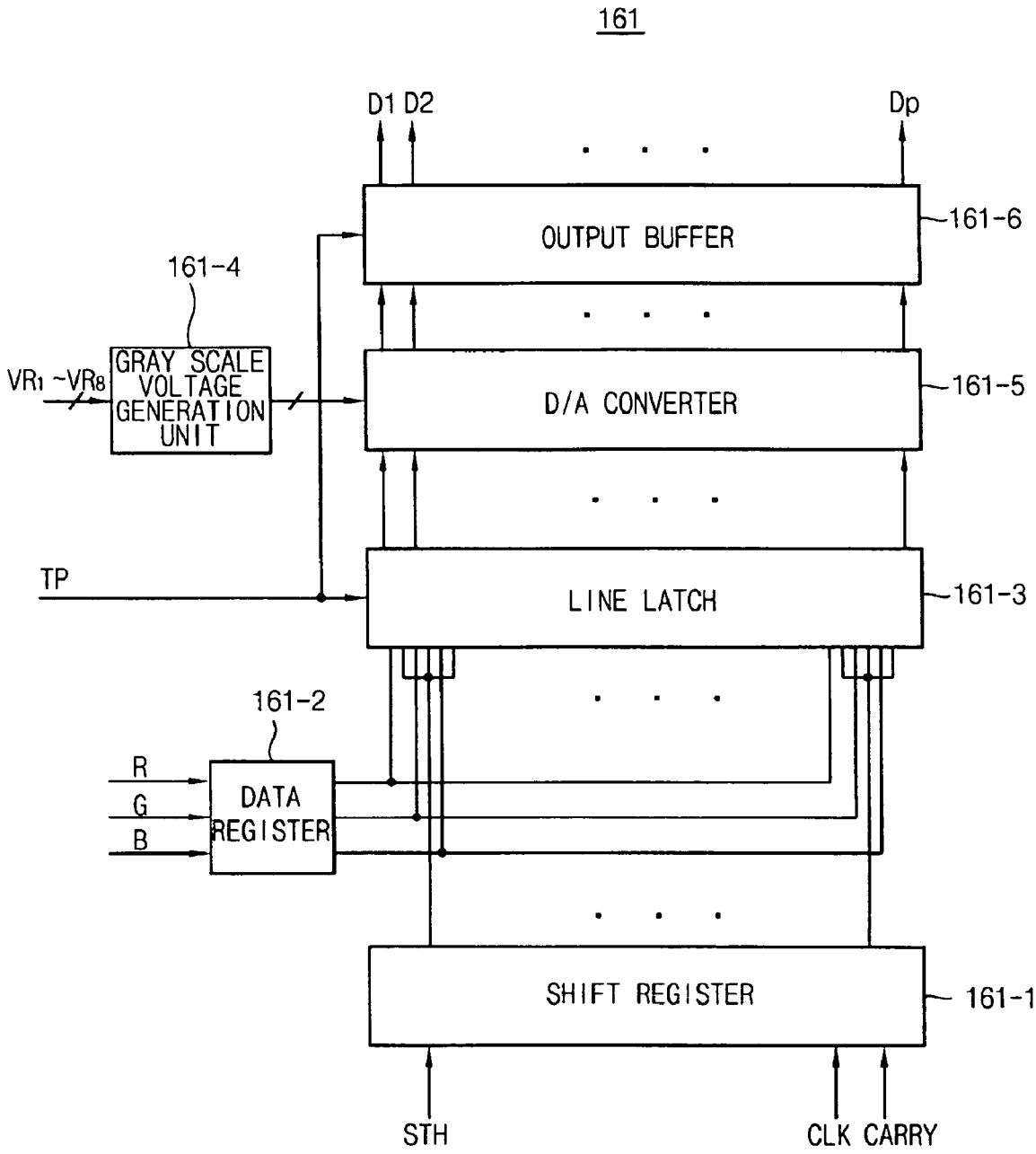
FIG. 3 is a detailed block diagram illustrating a first data driver chip in FIG. 2.

FIG. 2 is a block diagram illustrating the data driver 160 in FIG. 1 and FIG. 3 is a detailed block diagram illustrating a first data driver chip in FIG. 2.

Referring to FIG. 2, the data driver 160 includes a plurality of driver chips 161 through 163 that receive a predetermined number of reference gray scale voltages (VR1~VR8), the image data DATA and the control signal CONTL. In addition, each of the driver chips 161 through 163 receives a carry signal 161*a* or 162*a* from a previous driver chip.

Referring to FIG. 3, a first data driver chip 161 includes a shift register 161-1, a data register 161-2, a line latch 161-3, a gray scale voltage generation unit 161-4, a digital-to-analog (D/A) converter 161-5 and an output buffer 161-6.

The shift register 161-1 provides a latch pulse to the line latch 161-3 based on the horizontal synchronization start signal STH transmitted from the timing controller 110.

The data register 161-2 latches the image data DATA, namely, red (R), green (G) and blue (B) data (RGB data) sequentially transmitted from the timing controller 110 to respective corresponding input terminals of the line latch 161-3. When the latch pulse is inputted from the shift register 161-1, the latched RGB data are outputted to the line latch 161-3.

The line latch 161-3 latches the RGB data by a unit of line. When the load signal TP from the timing controller 110 is applied to the line latch 161-3, the latched RGB data are outputted to the digital-to-analog converter 161-5.

The gray scale voltage generation unit 161-4 includes a fixed dividing resistor to generate gray scale voltages corresponding to the number of given gray scale levels based on the predetermined number of the reference gray scale voltages VR1-VR8 provided from the reference gray scale voltage generation unit 150. For example, the number of the given gray scale levels may be 64, 256, etc.

The digital-to-analog converter 161-5 converts the R, G, B digital data provided from the line latch 161-3 to analog data voltages based on the reference gray scale voltages provided from the gray scale voltage generation unit 161-4.

The output buffer 161-1 amplifies and outputs the converted analog data voltage. Namely, data voltages D1, D2 . . . and Dp are provided to the data line DL of the liquid crystal display panel 180 through the output buffer 161-1.

Figure 4:
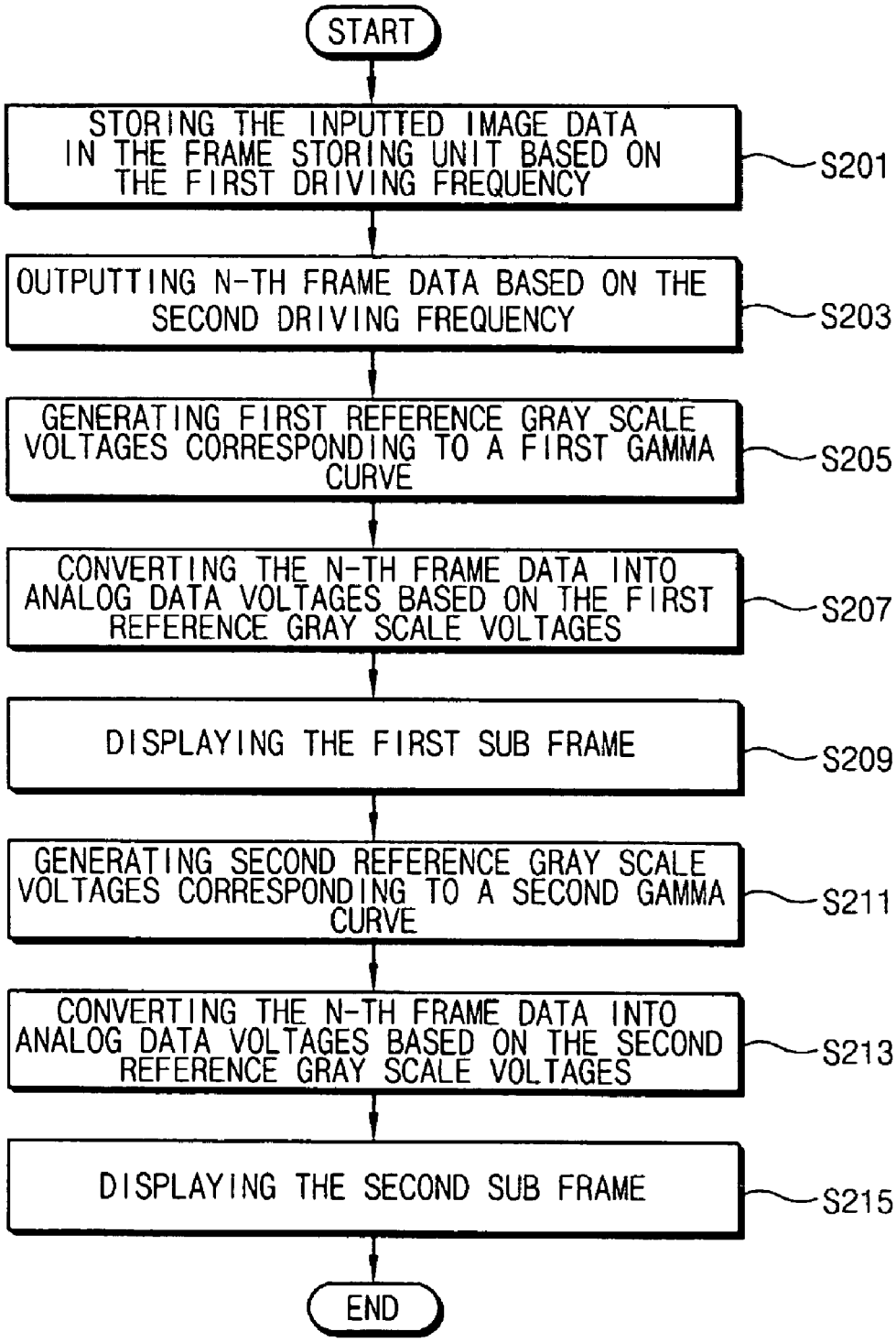
FIG. 4 is a flowchart diagram illustrating a method of driving a liquid crystal display device according to an exemplary embodiment of the present invention.
Figure 5A:
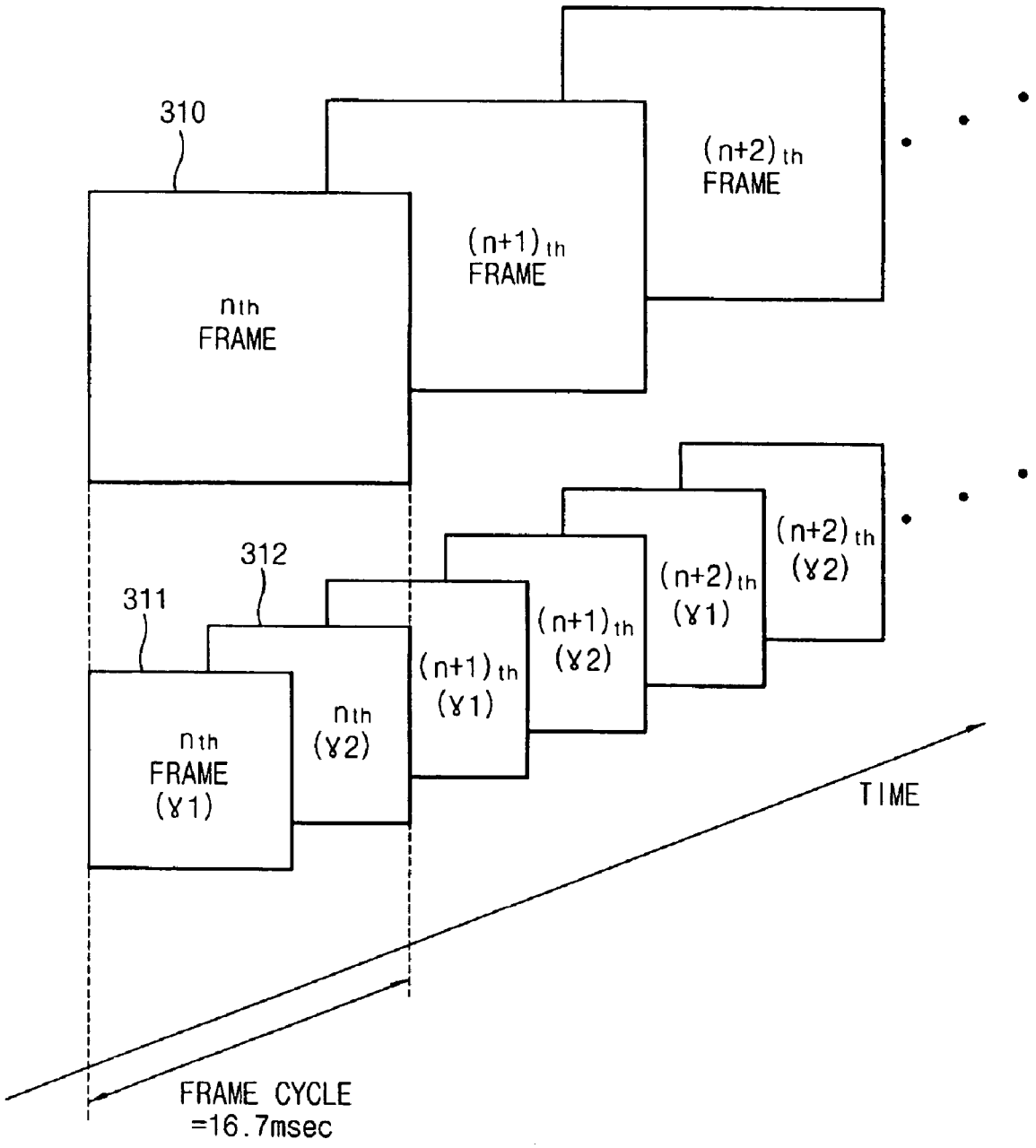
FIG. 5A is a schematic view illustrating a frame on a display according to an exemplary embodiment of the present invention.
Figure 5B:
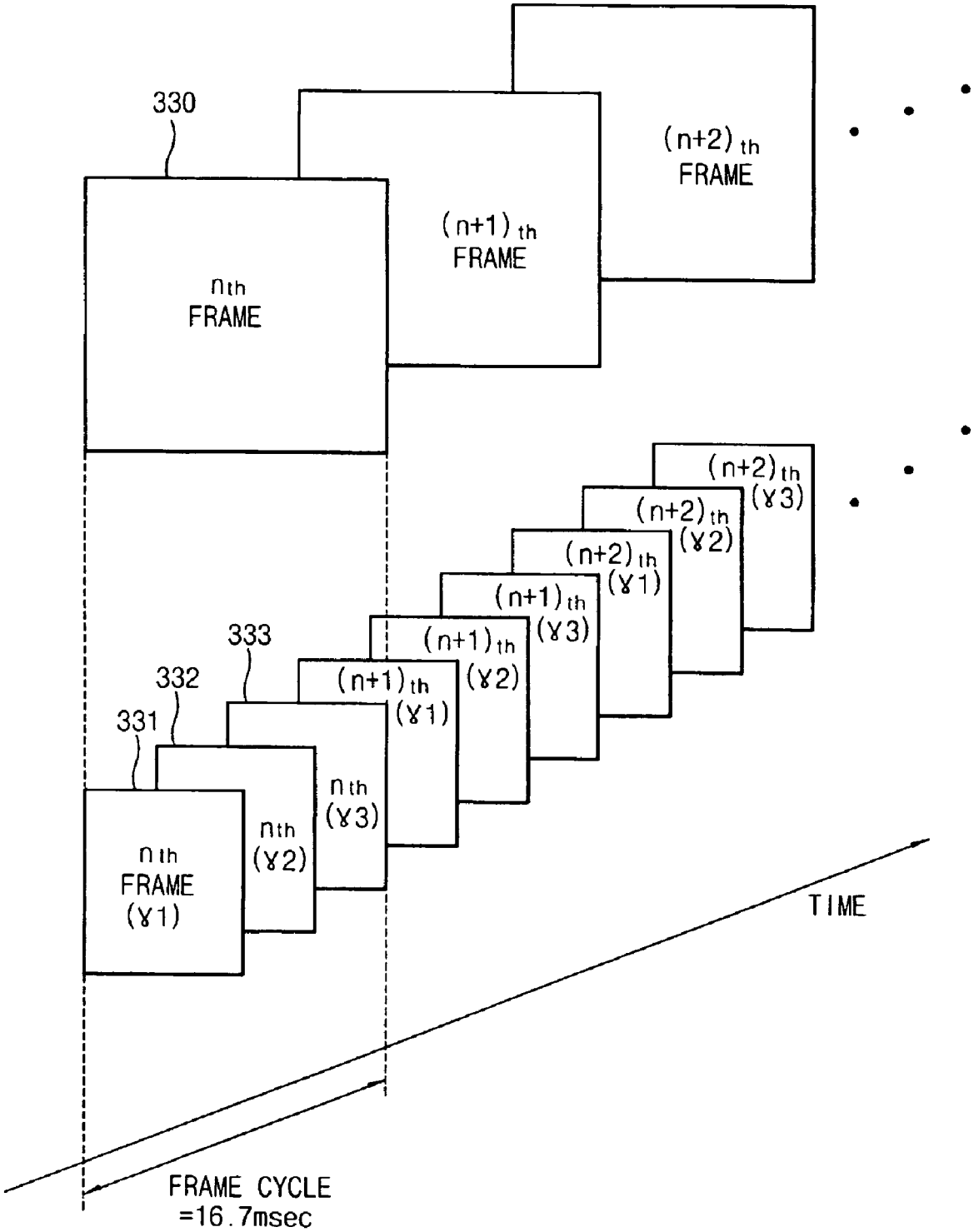
FIG. 5B is a schematic view illustrating a frame on a display according to another exemplary embodiment of the present invention.

FIG. 4 is a flowchart diagram illustrating a method of driving a liquid crystal display device according to an exemplary embodiment of the present invention. FIG. 5A is a schematic view illustrating a frame on a display according to an exemplary embodiment of the present invention and FIG. 5B is a schematic view illustrating a frame on a display according to another exemplary embodiment of the present invention.

Referring to FIGS. 1 through 5A, the image data inputted from the external device is stored based on the first driving frequency in the frame storing unit 120 by a unit of frame (step S201).

The timing controller 110 outputs n-th frame data 310 in FIG. 5A from the frame storing unit 120 based on the second driving frequency that is m times the first driving frequency (step S203). For example, the first driving frequency may be about 60 Hz and the second driving frequency may be about 120 Hz.

The timing controller 110 outputs the n-th frame data 310 to the data driver 160. Additionally, the timing controller 110 outputs a predetermined number of first reference gray scale data corresponding to a first gamma curve having a normal gamma value γ1 and provides the first reference gray scale data to the reference gray scale voltage generation unit 150. Based on the first reference gray scale data, the reference gray scale voltage generation unit 150 generates a predetermined number of first reference gray scale voltages (step S205). The first reference gray scale voltage is provided to the data driver 160.

The data driver 160 generates the gray scale voltages corresponding to the number of the given gray scale levels based on the predetermined number of the first reference gray scale voltages. The data driver 160 converts the n-th frame data into analog data voltages based on the gray scale voltages and provides the analog data voltages to the liquid crystal display panel 180 (step S207). Based on the analog data voltages, the n-th frame data 310 to which the normal gamma curve γ1 is applied is displayed in the first sub fame 311 on the liquid crystal display panel 180 (step S209).

Subsequently, the timing controller 110 again provides the data driver 160 with the n-th frame data 310 that is outputted from the frame storing unit 120 in step S203. The timing controller 110 outputs a predetermined number of second reference gray scale data corresponding to a second gamma curve having a second gamma value γ2 greater than the first gamma value γ1 of the normal gamma curve. The reference gray scale voltage generation unit 150 generates a predetermined number of second reference gray scale voltages using the second reference gray scale data (step S211). The reference gray scale data generation unit 150 may provide the second reference gray scale voltages to the data driver 160.

Alternatively, in step S211, the timing controller 110 may output the second reference gray scale data based on the gamma selection signal transmitted from the user interface (not shown). The gamma selection signal may enable the user to directly select one gamma curve among a plurality of gamma curves. The reference gray scale data generation unit 150 may generate a predetermined number of the second reference gray scale voltages using a predetermined number of the second reference gray scale data corresponding to the selected gamma curve of the user.

The data driver 160 generates gray scale voltages corresponding to the number of the gray scale level based on the second reference gray scale voltages. The data driver 160 converts the n-th frame data into the analog data voltages based on the gray scale voltages to output the converted data voltage to the liquid crystal display panel 180 (step S213). Accordingly, the n-th frame data 310 to which the second gamma curve is applied is displayed in a second sub frame 312 on the liquid crystal display panel 180 (step S215).

The second driving frequency is twice the first driving frequency so that the n-th frame data 310 is displayed in the first sub frame 311 to which the normal gamma curve is applied and the second sub frame 312 to which the second gamma curve having the greater gamma value than the normal gamma curve is applied.

It is noted that the n-th frame may be alternatively displayed in the first sub frame using the gamma curve having the gamma value greater than the normal gamma value during an initial part of the frame cycle and displayed in the second sub frame using the normal gamma curve during the remaining part of the frame cycle. When the display device has the driving frequency of 60 Hz, both the first and second sub frames 311 and 312 may be displayed within a period of 1/60 second (i.e., 16.7 ms).

Referring to FIG. 5B, the sub frames are displayed at the second driving frequency that is third times the first driving frequency. For example, the first driving frequency may be about 60 Hz and the second driving frequency may be about 180 Hz.

As shown in FIG. 5B, the n-th frame data 330 are displayed in first, second and third sub frames 331, 332 and 333. The first gamma curve having the normal gamma value γ1 is applied to the first sub frame 331 and the second and third gamma curves having second and third gamma values γ2 and γ3 greater than the normal gamma value γ1, are applied to the second and third sub frames 332 and 333, respectively. The respective gamma values of the first, second and third gamma curves satisfy the following relationship as $\gamma1<\gamma2<\gamma3$. Alternatively, the respective gamma values of the first, second and third gamma curves satisfy the relationship $\gamma1<\gamma3<\gamma2$. For example, the difference between either the second or third gamma value γ2 or γ3 and the normal gamma value γ1 may exceed 3.

The first and second sub frames 331 and 332 may be displayed using the second and third gamma curves having the gamma values γ2 and γ3 greater than the normal gamma value γ1 during an initial part of the frame cycle and the third sub frame 333 may be displayed using the normal gamma curve during the remaining part of the frame cycle. When the display device has the driving frequency of 60 Hz, the first through third sub frames 331 to 333 may be displayed within a period of 1/60 second (i.e., 16.7 ms).

Alternatively, the first sub frame 331 may be displayed using the second gamma curve having the second gamma value $\gamma 2$ greater than the normal gamma value $\gamma 1$, the second sub frame 332 may be displayed using the normal gamma curve and the third sub frame 333 is displayed using the third gamma curve having the third gamma value $\gamma 3$ greater than the normal gamma value $\gamma 1$.

Thus, the frame to which the gamma curve having the greater gamma value is applied may be inserted to the frame to which the normal gamma curve is applied and therefore, the generation of the motion blur is prevented.

Figure 6:
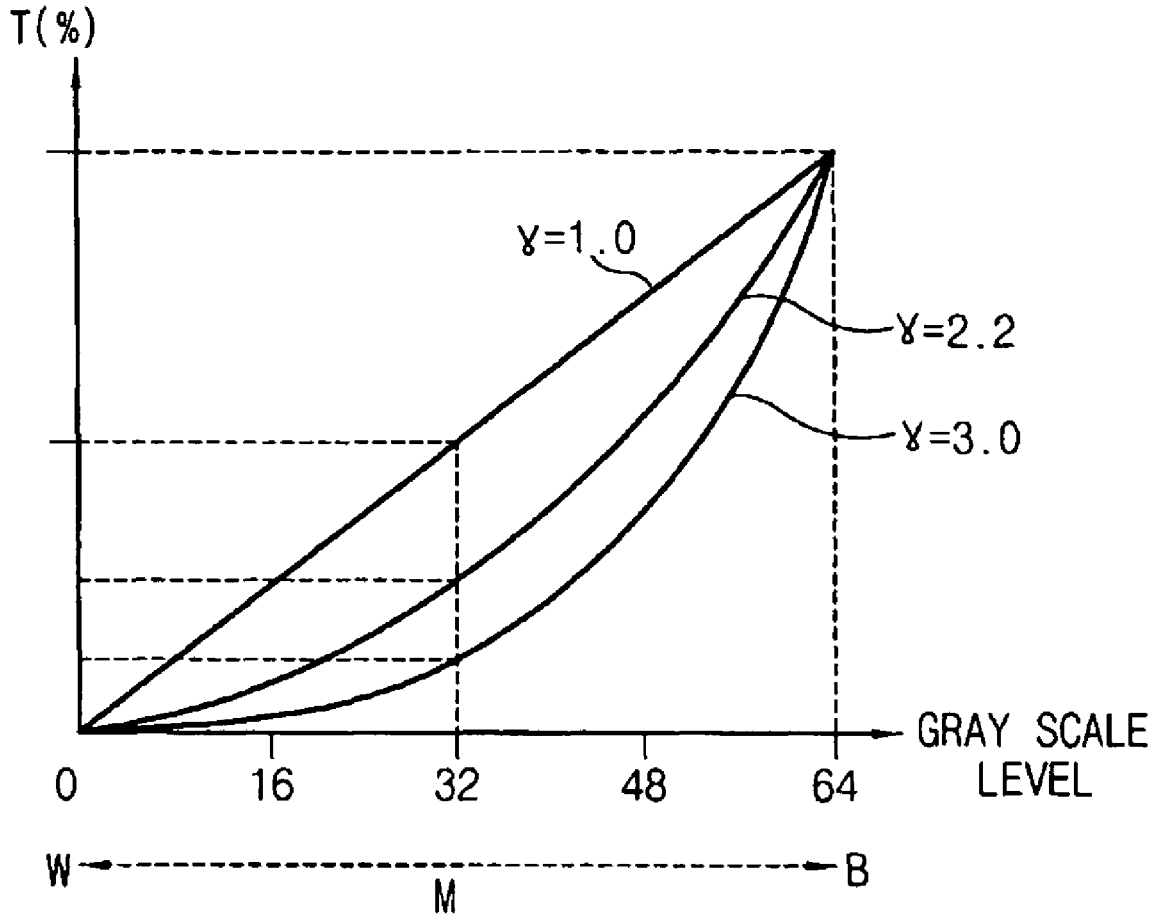
FIG. 6 is a graph showing gamma curves adopted for an exemplary embodiment of the present invention.

FIG. 6 is a graph showing gamma correction curves adopted for an exemplary embodiment of the present invention.

In FIG. 6, an x-axis corresponds to the gray scale level and a y-axis corresponds to light transmittance. As shown in FIG. 6, as the gamma value $\gamma$ is increased, the reference gray scale voltages corresponding to a halftone (M) gray scale level have a variance relatively greater than those corresponding to a white (W) or black (B) gray scale level. Conversely, the variance in the reference gray scale voltages at the white (W) or black (B) gray scale level is relatively smaller than those corresponding to the halftone (M) gray scale level. Namely, when the gamma value $\gamma$ is increased, the reference gray scale voltages may be significantly decreased at the halftone (M) gray scale level while the reference gray scale voltages at the white (W) or black (B) gray scale level exhibit little change.

Thus, using such characteristics of the gamma curves, the frame data may be displayed in the first sub frame using the normal gamma value and at least one second sub frame using at least one gamma value greater than the normal gamma value to prevent the motion blur. Accordingly, the gamma values greater than the normal gamma value may be used to significantly decrease the reference gray scale voltage corresponding to the halftone gray scale level to compensate for the halftone gray scale data that produces an image with a relatively greater motion blur. In addition, the reference gray scale voltages at the white (W) or black (B) gray scale level that produces an image with a relatively less motion blur may have a little variance to prevent data loss at the white or black gray scale level.

As described above, exemplary embodiments of the present invention may provide the display device having an improved brightness compared with the conventional display device employing a method of inserting black pictures. Therefore, the display device according to exemplary embodiments of the present invention may display moving pictures in a high display quality.

Having thus described exemplary embodiments of the present invention, it is to be understood that the invention defined by the appended claims is not to be limited by particular details set forth in the above description as many apparent variations thereof are possible without departing from the spirit or scope thereof as hereinafter claimed.

What is claimed is:

1. A display device, comprising:

a display panel configured to display images corresponding to a first data voltage and a second data voltage for a frame, the frame having a first sub frame and a second sub frame; and a driver configured to provide the display panel with the first data voltage corresponding to frame data inputted from an external device according to a first gamma curve during the first sub frame and configured to provide the display panel with the second data voltage corresponding to the frame data according to a second gamma curve during the second sub frame, wherein a gamma value of the second gamma curve is greater than a gamma value of the first gamma curve and the driver includes:

a gamma storing unit configured to store a first reference gray scale data corresponding to the first gamma curve and a second reference gray scale data corresponding to the second gamma curve;

a reference gray scale voltage generation unit configured to generate a first reference gray scale voltage and a second reference gray scale voltage based on the first and second reference gray scale data, respectively; and a data driver configured to convert the frame data into the first and second data voltages based on the first and second reference gray scale voltages, respectively, and configured to provide the first and second data voltages to the display panel.

2. The display device of claim 1, wherein the second sub frame includes m (m is an integer) sub frames using m second gamma curves whose gamma values are greater than the gamma value of the first gamma curve.

3. The display device of claim 2, further comprising:

a frame storing unit configured to store the frame data based on a first driving frequency; and a timing controller configured to read out the frame data stored in the frame storing unit based on a second driving frequency, wherein the second driving frequency is (m+1) times the first driving frequency.

4. The display device of claim 1, wherein the second gamma curve is selectable by a user.

5. The display device of claim 1, wherein the first sub frame is displayed during a first interval of a frame cycle of the frame data and the second sub frame is displayed during a second interval of the frame cycle, wherein a length of the first interval is equal to a length of the second interval.

6. The display device of claim 1, wherein the first sub frame is displayed during a first interval of a frame cycle of the frame data and the second sub frame is displayed during a second interval of the frame cycle, and wherein a length of the second interval is longer than a length of the first interval.

7. The display device of claim 6, wherein a ratio of the length of the second interval to the length of the first interval is less than about 2.

8. The display device of claim 5, wherein a sum of the first and second intervals is substantially 16.7 ms.

9. The display device of claim 1, wherein the first sub frame is represented by the first data voltage and the second sub frame is represented by the second data voltage.

10. The display device of claim 1, wherein the data driver includes:

a gray scale voltage generation unit configured to divide the reference gray scale voltage to gray scale voltages corresponding to a number of gray scale levels; and a digital-to-analog converter configured to convert the frame data into the first and second data voltages based on the gray scale voltages.

11. The display device of claim 1, wherein the gamma value of the second gamma curve is greater than the gamma value of the first gamma curve by at least three.

12. An apparatus for driving a display device having a display panel for displaying an image signal, the apparatus comprising:

a gamma storing unit configured to store first reference gray scale data corresponding to a first gamma curve and second reference gray scale data corresponding to a second gamma curve whose gamma value is greater than a gamma value of the first gamma curve;

a reference gray scale voltage generation unit configured to generate a first reference gray scale voltage and a second reference gray scale voltage based on the first and second reference gray scale data, respectively; and a data driver configured to convert frame data inputted from an external device into first and second data voltages based on the first and second reference gray scale voltages, respectively, and configured to provide the first and second data voltages to the display panel.

13. The apparatus of claim 12, wherein the first data voltage is provided to the display panel during a first sub frame of a frame, wherein the second data voltage is provided to the display panel during a second sub frame of the frame.

14. The apparatus of claim 13, wherein the second sub frame includes m (m is an integer) sub frames using m second gamma curves whose gamma curves are greater than the gamma value of the first gamma curve.

15. The apparatus of claim 14, further comprising:

a frame storing unit configured to store the frame data based on a first driving frequency; and a timing controller configured to read out the frame data stored in the frame storing unit based on a second driving frequency, wherein the second driving frequency is (m+1) times the first driving frequency.

16. The apparatus of claim 12, wherein the second gamma curve is selectable by a user.

17. The apparatus of claim 13, wherein the first sub frame is displayed during a first interval of a frame cycle of the frame data, the second sub frame is displayed during a second interval of the frame cycle, and a length of the first interval is equal to a length of the second interval.

18. The apparatus of claim 13, wherein the first sub frame is displayed during a first interval of a frame cycle of the frame data, the second sub frame is displayed during a second interval of the frame cycle, and a length of the second interval is longer than a length of the first interval.

19. The apparatus of claim 18, wherein a ratio of the length of the second interval to the length of the first interval is less than about 2.

20. The apparatus of claim 17, wherein a sum of the first and second intervals is substantially 16.7 ms.

21. The apparatus of claim 12, wherein the data driver includes:

a gray scale voltage generation unit configured to divide the reference gray scale voltage to gray scale voltages corresponding to a number of gray scale levels; and a digital-to-analog converter configured to convert the frame data into the first and second data voltages based on the gray scale voltages.

22. The apparatus of claim 12, wherein the gamma value of the second gamma curve is greater than the gamma value of the first gamma curve by at least three.

23. A method of driving a display device, the method comprising:

receiving frame data from an external device to display an image for a frame;

storing the frame data based on a first driving frequency;

reading out the frame data stored in the frame storing unit based on a second driving frequency; and displaying a first data voltage corresponding to the frame data according to a first gamma curve during a first sub frame and displaying a second data voltage corresponding to the frame data according to a second gamma curve during a second sub frame, the first sub frame and the second sub frame being parts of the frame, wherein a gamma value of the second gamma curve is greater than a gamma value of the first gamma curve.

24. The method of claim 23, wherein a length of the first sub frame is equal to a length of the second sub frame.

25. The method of claim 23, wherein a length of the second sub frame is longer than a length of the first sub frame.

26. The method of claim 25, wherein a ratio of the length of the second sub frame to the length of the first sub frame is less than about 2.

27. The method of claim 23, wherein a sum of the first and second sub frames is substantially 16.7 ms.

28. The method of claim 23, wherein the displaying the first and the second data voltages comprises:

generating a first reference gray scale voltage corresponding to the first gamma curve;

converting the frame data into a first data voltage based on the first reference gray scale voltage;

outputting the first data voltage to display during the first sub frame;

generating a second reference gray scale voltage corresponding to the second gamma curve whose gamma value is greater than a gamma value of the first gamma curve;

converting the frame data into the second data voltage based on the second reference gray scale voltage; and outputting the second data voltage to display during the second sub frame.

29. The method of claim 23, wherein the second driving frequency is m times the first driving frequency.

30. The method of claim 29, wherein the frame data are displayed in m sub frames.

31. The method of claim 23, wherein the gamma value of the second gamma curve is greater than the gamma value of the first gamma curve by at least three.

32. The display device of claim 1, wherein a variance of the second data voltage corresponding to a halftone (M) gray scale level is greater than a variance of the second data voltage corresponding to a white (W) or black (B) gray scale level, so that a difference between the first data voltage and the second data voltage in the halftone (M) gray scale level is greater than a difference between the first data voltage and the second data voltage in the white (W) or black (B) gray scale level.

33. The apparatus of claim 12, wherein a variance of the second reference gray scale voltage corresponding to a halftone (M) gray scale level is greater than a variance of the second reference gray scale voltage corresponding to a white (W) or black (B) gray scale level, so that a difference between the first reference gray scale voltage and the second reference gray scale voltage in the halftone (M) gray scale level is greater than a difference between the first reference gray scale voltage and the second reference gray scale voltage in the white (W) or black (B) gray scale level.

34. The method of claim 23, wherein a variance of the second data voltage corresponding to a halftone (M) gray scale level is greater than a variance of the second data voltage corresponding to a white (W) or black (B) gray scale level, so that a difference between the first data voltage and the second data voltage in the halftone (M) gray scale level is greater than a difference between the first data voltage and the second data voltage in the white (W) or black (B) gray scale level.

* * * * *